US007135661B2

(12) United States Patent
Park et al.

(10) Patent No.: US 7,135,661 B2
(45) Date of Patent: Nov. 14, 2006

(54) INDUCTION HEATING COOKER WITH HORIZONTAL EXHAUST PASSAGE

(75) Inventors: Byeong Wook Park, Gyeonggi-do (KR); Jong Sik Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/203,235

(22) Filed: Aug. 15, 2005

(65) Prior Publication Data

US 2006/0049177 A1 Mar. 9, 2006

(30) Foreign Application Priority Data

Aug. 16, 2004 (KR) ..... 10-2004-0064173

(51) Int. Cl.
*H05B 6/12* (2006.01)
*F24C 15/10* (2006.01)

(52) U.S. Cl. ..... 219/623; 219/632; 219/677; 126/21 A

(58) Field of Classification Search ..... 219/622–624, 219/632, 677, 478; 126/299 D, 299 R, 21 A; 99/DIG. 14
See application file for complete search history.

(56) References Cited

U.S. PATENT DOCUMENTS 4,551,600 A * 11/1985 Miyagawa et al. ..... 219/623
4,665,893 A * 5/1987 Miyagawa et al. ..... 126/299 D

FOREIGN PATENT DOCUMENTS

JP 5-121155 * 5/1993 ..... 219/623

* cited by examiner

*Primary Examiner*—Philip H. Leung
(74) *Attorney, Agent, or Firm*—Birch, Stewart, Kolasch & Birch, LLP

(57) ABSTRACT

An induction heating cooker with improved discharge capability and cooling performance comprises a cooking plate 200 formed with a cooking vessel thereon; a cooking body 310 coupled to the cooking plate 200 to define a receiving space 311 therebetween and having an exhaust port 312 communicating with the receiving space 311; a plurality of unit induction heating modules 410 and 420 installed within the receiving space 311 to be partitioned from each other, each having a heating unit 412 or 422, a blowing fan 413 or 423 disposed close to the heating unit to cool the heating unit 412 or 422, and an exhaust passage 415 or 425 for allowing exhaust air generated by the blowing fan 413 or 423 to be guided to and discharged through the exhaust port 312; and a bridge duct 810 for allowing the exhaust passages 415 and 425 of the unit induction heating modules 410 and 420 to communicate with each other, to thereby enable to improve the cooling performance.

20 Claims, 4 Drawing Sheets

INDUCTION HEATING COOKER WITH HORIZONTAL EXHAUST PASSAGE

BACKGROUND OF THE INVENTION

1. Field of the Invention

The present invention relates to an induction heating cooker for heating food using an electromagnetic induction method. In particular, the invention relates to an induction heating cooker by which discharge capability and cooling performance can be improved.

2. Description of the Related Art

Recently, induction heating cookers employing an induction heating method has gained popularity as a future cooking appliance, because its stability and economical efficiency is excellent as compared with a conventional cooling appliance such as a gas stove. Such an induction heating cooker is a cooking appliance using direct heating method. In such a case, when Alternating Current (AC) is applied to an induction heating coil in an induction oven, a magnetic field is produced to induce an eddy current effect on the bottom of a vessel (e.g., a receptacle containing iron ingredients) placed at the center of the magnetic field and to generate heat.

Referring to FIG. 1, a set of cooker with four induction heating (IH) modules is generally employed as the aforementioned induction heating cooker. Referring again to FIG. 1, the conventional induction heating cooker with four IH modules is modularized, to maximize common use of its internal parts, in such a manner that two burners 104 and 102 installed at the front and rear of the right side and two burners 103 and 101 installed at the front and rear of the left side are placed in the same spaces within the cooker.

Further, induction heating modules, a blowing fan 105 and a heat sink 106, both of which are used for cooling the modules, are installed below a region between a pair of burners 102 and 104 and a pair of burners 101 and 103.

However, there is a problem in the conventional induction heating cooker thus configured in that its cooling efficiency is reduced in case the conventional blowing fan 105 of small capacity and the heat sink 106 are used as before to cool the four induction heating modules.

A large quantity of blowing air is required if the four induction heating modules are to be effectively cooled. Thus, in order to satisfy the above requirements, a relatively larger blowing fan 105 and a heat sink 106 should be installed. There is another problem in that the degree of freedom in which internal parts are installed and the efficiency in which the internal parts are commonly used are reduced. There is still another problem in that overall size of the cooker is unnecessarily increased.

There is still further problem in that since the four induction heating modules are installed in the same chamber, the heating efficiency is decreased by frequency interference produced when the four induction heating modules are simultaneously operated.

SUMMARY OF THE INVENTION

The present invention is conceived to solve the aforementioned problems and it is an object of the present invention to provide an induction heating cooker in which two induction heating modules are partitioned from each other and an integrated exhaust passage is also formed to improve its cooling efficiency.

According to an aspect of the present invention for achieving the object, there is provided an induction heating cooker, comprising a cooking plate formed with a cooking vessel thereon; a cooking body coupled to the cooking plate to define a receiving space therebetween and having a single exhaust port communicating with the receiving space; and a plurality of unit induction heating modules installed within the receiving space to be partitioned from each other, where exhaust passages are interconnected to communicate with the single exhaust port.

According to another aspect of the present invention, there is provided an induction heating cooker, comprising a cooking plate formed with a cooking vessel thereon; a cooking body coupled to the cooking plate to define a receiving space therebetween and having an exhaust port communicating with the receiving space; a plurality of unit induction heating modules formed within the receiving space to be partitioned from each other, each module having a heating unit, a blowing fan disposed close to the heating unit to dissipate the heat generated by the heating unit, and an exhaust passage for allowing exhaust air generated by the blowing fan to be guided to and discharged through the exhaust port; and a bridge duct for allowing the exhaust passages of the unit induction heating modules to communicate thereamong.

Preferably, the bridge duct is installed on the same axis as that of the exhaust port.

Further, the bridge duct may be made of a heat resistant molding material or polypropylene.

Furthermore, the blowing fan of each of the unit induction heating modules is spaced apart by a maximum distance from the exhaust port.

A heat sink may be installed between the blowing fan and the exhaust port.

Preferably, a blowing fan farthest from the exhaust port has a relatively higher power compared with other blowing fans.

BRIEF DESCRIPTION OF THE DRAWINGS

The above and other objects, features and advantages of the present invention will become apparent from the following descriptions of preferred embodiments given in conjunction with the accompanying drawings, in which.

DETAILED DESCRIPTION OF THE INVENTION

Hereinafter, preferred embodiments of the induction heating cooker according to the present invention will be described in detail with reference to the accompanying drawings.

Figure 1:
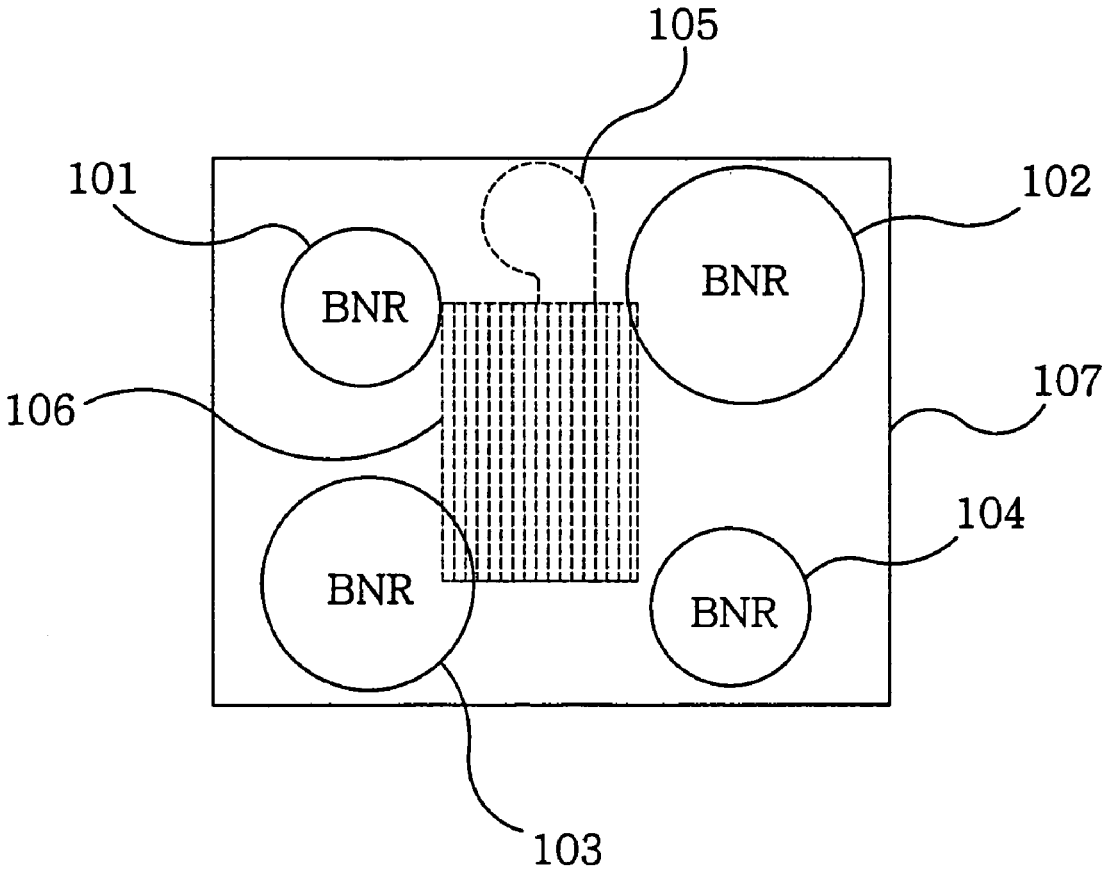
FIG. 1 Related Art
FIG. 1 is a plan view of a general induction heating cooker with four induction heating modules.
Figure 2:
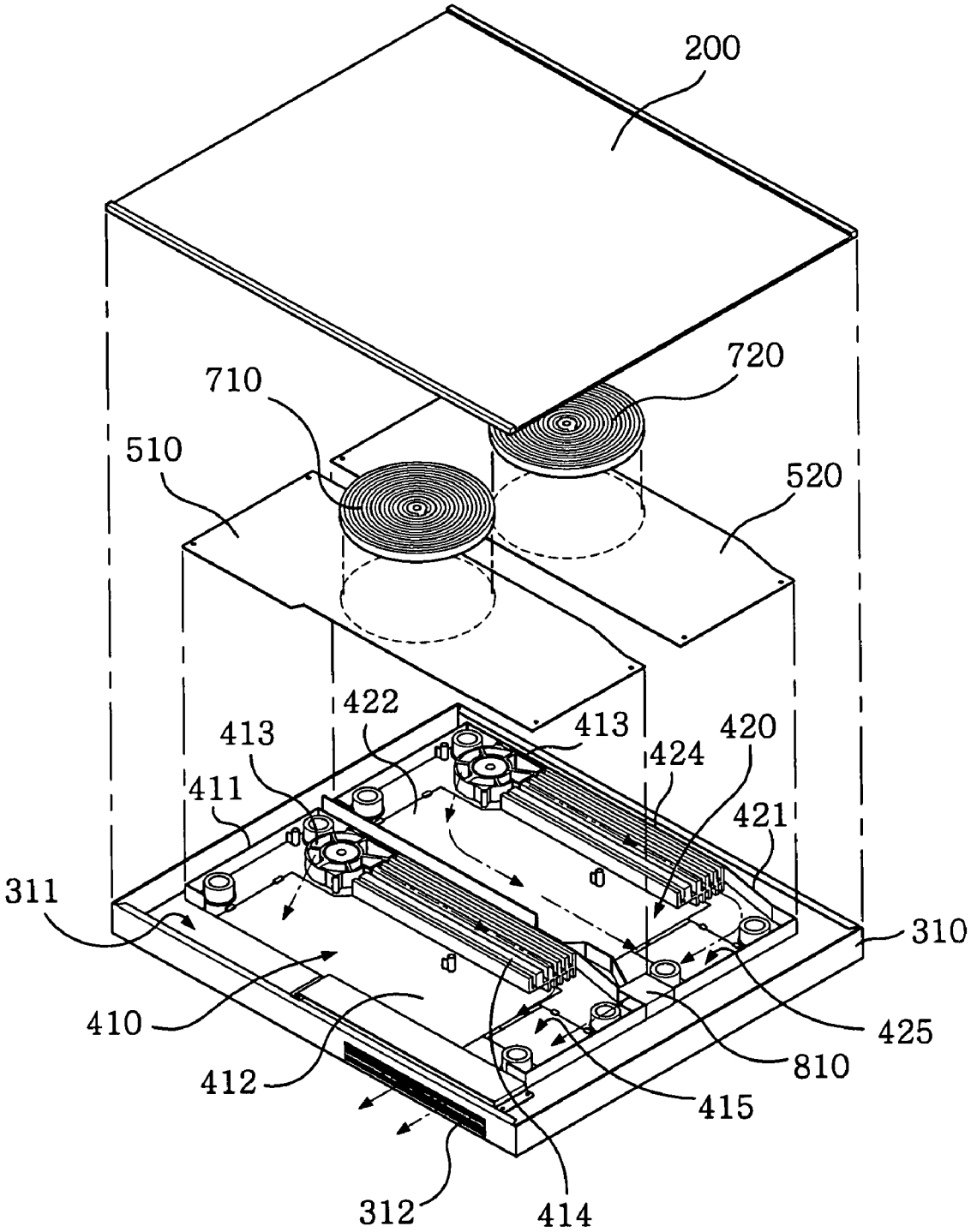
FIG. 2 is an exploded perspective view of an induction heating cooker according to a preferred embodiment of the present invention.

Referring to FIG. 2, an induction heating cooker of the present invention comprises a cooking plate 200 formed at the uppermost of the cooker on which a metal vessel is seated, a cooking body 310 coupled to the cooking plate 200, and first and second induction heating modules 410 and 420 installed within the cooking body 310. Reference numerals

510 and 520 denote first and second base seats each installed on the top of the unit induction heating modules 410 and 420.

The cooking plate 200 made of ceramic glass is coupled to the cooking body 310 with a predetermined size of receiving space 311 defined therebetween. An exhaust port 312 through which heated air is discharged to the outside is laterally formed at the cooking body 310.

The first and second unit induction heating modules 410 and 420 are arranged in parallel with each other within the receiving space 311 defined by the cooking plate 200 and the cooking body 310. Each of the first and second unit induction heating modules 410 and 420 includes a module casings 411 and 421 each coupled to the cooking body 310 and defining a profile of the unit induction heating module 410 or 420, heating units 412 and 422 each installed within each module casing 411 or 412 and driving work coils 710 and 720 each serving as a driving device, blowing fans 413 and 423 for rapidly discharging heat generated when the work coils 710 and 720 are operated, and heat sinks 414 and 424 for smoothly discharging heat generated from the heating units 412 and 422.

In such a configuration, the heated air flowing along exhaust passages 415 and 425 each formed at the first and second unit induction heating modules 410 and 420 is mixed, and the mixed air is then discharged to the outside through the exhaust port 312 formed at the cooking body 310. In other words, a bridge duct 810 for connecting the exhaust passages 415 and 425 is provided at an interface between the first and second unit induction heating modules 410 and 420. The first unit induction heating module 410 communicates via the bridge duct 810 with the second unit induction heating module 420.

The bridge duct 810 is made of a molding material, such as polypropylene, which is excellent in heat resistance and does not interfere with electromagnetic waves and the like. The bridge duct 810 prevents exhaust air from flowing backward by separating the exhaust passages from each other. The bridge duct 810 is provided at an outer periphery of the first and second unit induction heating modules 410 and 420. The interior of the bridge duct 810 is hollowed such that the air can flow in a single direction therethrough.

To perform the smooth discharge of the heated air produced in the respective unit induction heating modules 410 and 420, the respective blowing fans 413 and 423 are so spaced apart as to maintain a maximum distance from the exhaust port 312 of the cooking body 310. Further, the blowing fan 423 of the second unit induction heating module 420 disposed at the rear of the cooking body 310 has a higher power than that of the blowing fan 413 of the first unit induction heating module 410 disposed at the front of the cooking body 310.

The first and second base seats 510 and 520 are coupled to the top of the module casings 411 and 421 of the unit induction heating modules 410 and 420, respectively. Thus, the interference caused by driving frequency and air flow between the respective unit induction heating modules 410 and 420 can be minimized.

Figure 3:
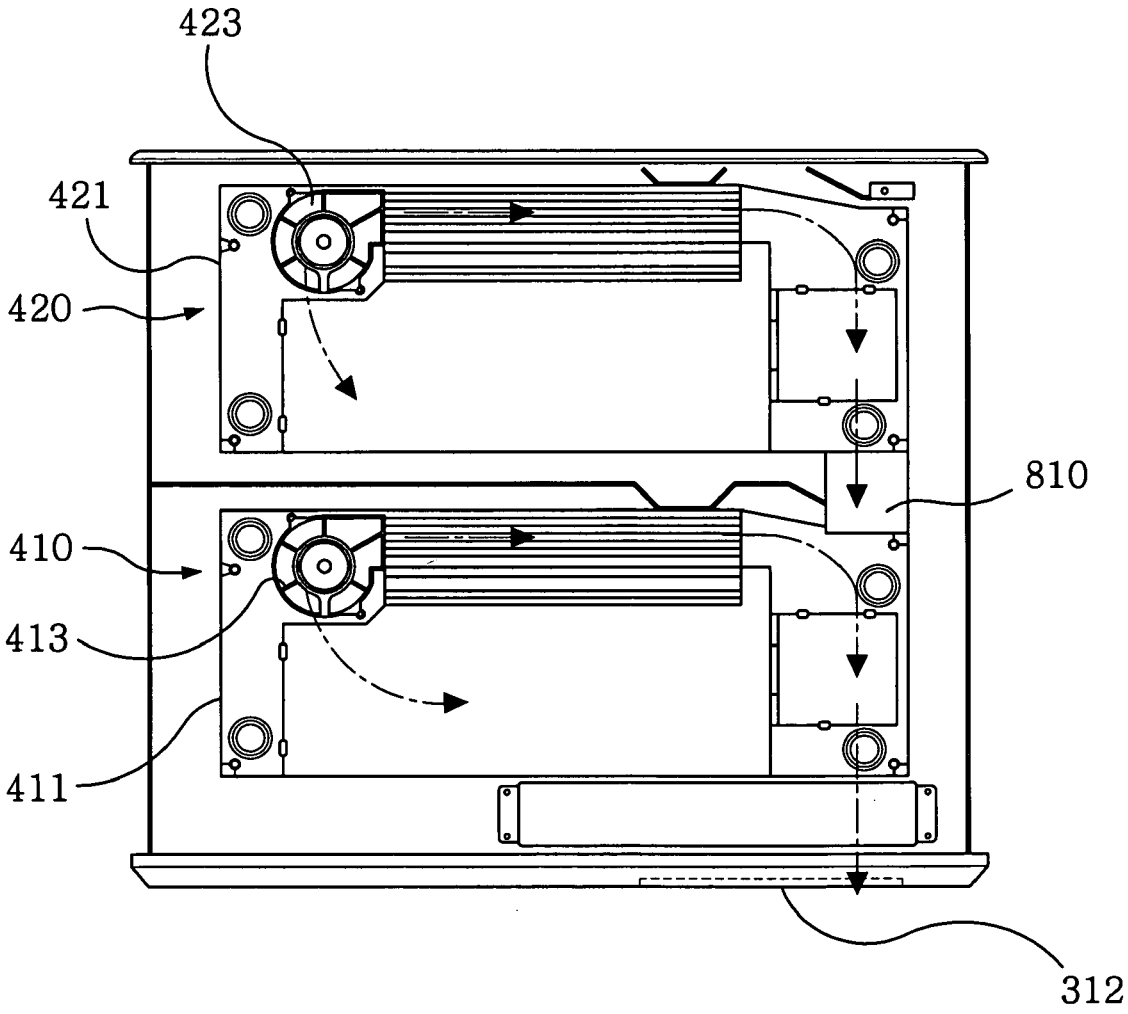
FIG. 3 is a plan view of the induction heating cooker shown in FIG. 2.

Hereinafter, the operation of the induction heating cooker according to the present invention will be described with reference to FIGS. 2 and 3.

The heating unit 412 of the first unit induction heating module 410 applies AC current to the work coil 710 installed on the first base seat 510 and drives the first work coil 710. If the work coil 710 is operated, the metal vessel placed on the cooking plate 200 above the work coil 710 is induction-heated to increase an inner temperature of the module casing 411. The heat thus generated in the module casing 411 flows toward the exhaust port 312 in response to rotation of the blowing fan 413.

The second unit induction heating module 420 also operates in the same way as that of the first unit induction heating module 410. The heat thus generated in the module casing 421 of the second unit induction heating module 420 flows toward the bridge duct 810 by the rotation of the blowing fan 423. The heat having passed the bridge duct 810 is mixed with the heat discharged from the first unit induction heating module 410, and the mixed air is then discharged to the outside through the exhaust port 312.

As described above, since the first and second induction heating modules 410 and 420 are separately installed and independently operated from each other, the interference caused by the driving frequency and air flow can be minimized.

Figure 4:
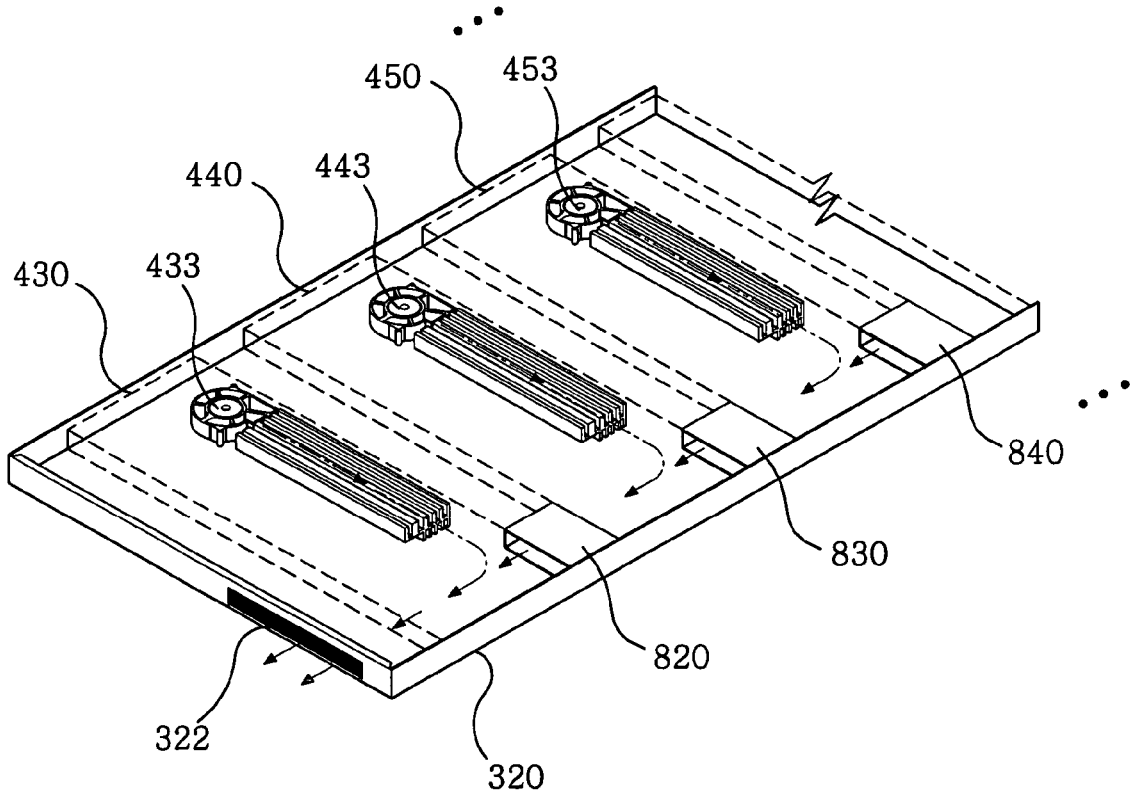
FIG. 4 is a plan view illustrating another embodiment of the present invention.

Hereinafter, another embodiment of an induction heating cooker according to the present invention will be explained with reference to FIG. 4.

The induction heating cooker according to another embodiment of the present invention is the same as the first embodiment but structurally expanded. More specifically, it is configured in such a manner that a plurality of induction heating modules 430, 440, and 450 are arranged in parallel within the cooking body 320.

For example, bridge ducts 820, 830 and 840 are formed at borders of the induction heating modules 430, 440 and 450.

Any blowing fan 433, 443 or 453 disposed farthest from the exhaust port 322 has a higher power than that of the other blowing fans. In other words, the farther from the exhaust port 322 the more power the blowing fan has. The shape or size of the exhaust port 322 may be properly modified not to create a bottle neck such that the air can be smoothly discharged.

Similar to the induction heating cooker according to the first preferred embodiment of the present invention, the respective bridge ducts 820, 830 and 840, each made of a molding material such as polypropylene, are excellent in heat resistance and are not affected by electromagnetic waves and the like. Each bridge 820, 830 or 840 is configured in such a manner that the interior is hollowed to allow the air flowing in each of the induction heating modules 430, 440 and 450 to flow in a single exhaust passage. Further, the bridge ducts are welded or fastened to their borders with the respective induction heating modules 430, 440 and 450 via fastening members. A horizontal axis of each respective bridge duct 820, 830 or 840 is aligned with the exhaust port 322 of the cooking body 320 such that its discharge capability can be maximized.

Since the respective exhaust passages can be unified into a single exhaust passage by installing the bridge ducts 820, 830 and 840, the intake/exhaust systems of the respective induction heating modules 430, 440 and 450 can be distinctly separated and the exhaust air can thus be prevented from flowing backward into the respective induction heating modules 430, 440 and 450.

As apparent from the foregoing, there is an advantage in the induction heating cooker according to the present invention in that a plurality of unit induction heating modules partitioned by the module casings can be formed within the cooking body, such that structural expansion of the cooker can be easily made and the frequency interference can be also minimized when the cooker is operated.

There is another advantage in that the exhaust passages through which the heated air produced in the respective unit induction heating modules flows are interconnected via the bridge ducts connecting the respective induction heating modules to further increase the discharge capability and to improve the cooling performance.

Although the present invention have been illustrated and described in connection with the preferred embodiments, it is only for illustrative purposes. It will be readily understood by those skilled in the art that various modifications and changes can be made thereto without departing from the spirit and scope of the present invention. Further, it is apparent that these modifications and changes fall under the scope of the present invention defined by the appended claims.

What is claimed is:

1. An induction heating cooker, comprising:

a cooker plate for holding a cooking vessel;

a cooking body coupled to the cooking plate to define a receiving space therebetween, the cooking body having an exhaust port communicating with the receiving space; and a plurality of unit induction heating modules installed within the receiving space and partitioned from each other, each of the unit induction heating modules including an exhaust passage, the exhaust passages being interconnected to communicate with the exhaust port, the exhaust passages be aligned with one another to provide a horizontal exhaust passage for horizontal delivery of exhaust to the exhaust port.

2. The induction heating cooker as claimed in claim 1, wherein the horizontal exhaust passage is for horizontal delivery of the exhaust through the exhaust port.

3. The induction heating cooker as claimed in claim 1, wherein the exhaust port faces one of the exhaust passages closest to the exhaust port.

4. The induction heating cooker as claimed in claim 1, wherein the exhaust port faces the exhaust passages.

5. The induction heating cooker as claimed in claim 1, wherein a horizontal axis of the exhaust passages is aligned with the exhaust port.

6. The induction heating cooker as claimed in claim 1, further comprising a bridge duct between two adjacent exhaust passages, the two adjacent exhaust passages facing each other.

7. The induction heating cooker as claimed in claim 1, wherein the exhaust port is located at a lateral side of the cooking body.

8. An induction heating cooker, comprising:

a cooking plate for holding a cooking vessel;

a cooking body coupled to the cooking plate to define a receiving space therebetween, the cooking body having an exhaust port communicating with the receiving space;

a plurality of unit induction heating modules located within the receiving space and partitioned from each other, each module having a heating unit, a blowing fan disposed close to the heating unit to dissipate the heat generated from the heating unit, and an exhaust passage for guiding exhaust air generated by the blowing fan to be discharged through the exhaust port; and a bridge duct for communicating two adjacent exhaust passages, the bridge duct having an inlet and an outlet, the inlet and the outlet of the bridge duct respectively facing the two adjacent exhaust passages.

9. The induction heating cooker as claimed in claim 8, wherein the bridge duct is made of a heat resistant molding material.

10. The induction heating cooker as claimed in claim 8, wherein the bridge duct is made of polypropylene.

11. The induction heating cooker as claimed in claim 8, wherein the blowing fan at each unit induction heating module is spaced apart by a maximum distance from the exhaust port.

12. The induction heating cooker as claimed in claim 8, wherein a heat sink is installed between the blowing fan and the exhaust port.

13. The induction heating cooker as claimed in claim 8, wherein the blowing fan of one of the unit induction heating modules farther from the exhaust port has a relatively higher power than the blowing fan of another one of the unit induction heating modules closer to the exhaust port.

14. The induction heating cooker as claimed in claim 8, the exhaust passages be aligned with one another to provide a horizontal exhaust passage for horizontal delivery of exhaust to the exhaust port.

15. The induction heating cooker as claimed in claim 14, wherein the horizontal exhaust passage is for horizontal delivery of the exhaust through the exhaust port.

16. The induction heating cooker as claimed in claim 8, wherein the two adjacent exhaust passages face each other.

17. The induction heating cooker as claimed in claim 8, wherein the exhaust port faces one of the exhaust passages closest to the exhaust port.

18. The induction heating cooker as claimed in claim 8, wherein a horizontal axis of the exhaust passages is aligned with the exhaust port.

19. The induction heating cooker as claimed in claim 8, wherein the exhaust port is located at a lateral side of the cooking body.

20. An induction heating cooker, comprising:

a cooking plate formed with a cooking vessel thereon;

a cooking body coupled to the cooking plate to define a receiving space therebetween and having an exhaust port communicating with the receiving space;

a plurality of unit induction heating modules formed within the receiving space to be partitioned from each other, each module having a heating unit, a blowing fan disposed close to the heating unit to dissipate the heat generated from the heating unit, and an exhaust passage for allowing exhaust air generated by the blowing fan to be guided to and discharged through the exhaust port; and a bridge duct for allowing the exhaust passages of the unit induction heating modules to communicate thereamong, wherein a horizontal axis of the bridge duct is aligned with the exhaust port.

* * * * *